US007628238B2

(12) United States Patent
Kobayashi et al.

(10) Patent No.: US 7,628,238 B2
(45) Date of Patent: Dec. 8, 2009

(54) ENGINE EXHAUST SYSTEM FOR A VEHICLE

(75) Inventors: Masanari Kobayashi, Yamato (JP); Takefumi Mitani, Sagamihara (JP)

(73) Assignee: Nissan Motor Co., Ltd., Yokohama (JP)

( * ) Notice: Subject to any disclaimer, the term of this patent is extended or adjusted under 35 U.S.C. 154(b) by 55 days.

(21) Appl. No.: 10/565,394

(22) PCT Filed: Jun. 28, 2005

(86) PCT No.: PCT/GB2005/002520

§ 371 (c)(1),
(2), (4) Date: Jan. 23, 2006

(87) PCT Pub. No.: WO2006/000811

PCT Pub. Date: Jan. 5, 2006

(65) Prior Publication Data

US 2006/0185924 A1 Aug. 24, 2006

(30) Foreign Application Priority Data

Jun. 29, 2004 (JP) ..... 2004-191152

(51) Int. Cl.
*B60K 13/04* (2006.01)

(52) U.S. Cl. ..... 180/89.2; 180/296; 60/322

(58) Field of Classification Search ..... 180/89.2, 180/309, 296, 219; 181/250, 207, 273, 227; 60/322, 299

See application file for complete search history.

(56) References Cited

U.S. PATENT DOCUMENTS 3,963,087 A * 6/1976 Grosseau ..... 180/309
4,676,332 A * 6/1987 Saito ..... 180/89.2
4,860,644 A * 8/1989 Kohl et al. ..... 454/65
5,127,489 A * 7/1992 Takato et al. ..... 180/309
5,323,989 A 6/1994 Hamada et al.
6,058,702 A * 5/2000 Jorg Alexnat et al. ..... 60/322
6,173,800 B1 * 1/2001 Steenackers et al. ..... 180/89.2
6,260,652 B1 * 7/2001 Steenackers et al. ..... 180/296
6,415,603 B1 * 7/2002 Nowka et al. ..... 60/322
6,536,548 B2 * 3/2003 Steenackers et al. ..... 180/89.2
6,758,300 B2 * 7/2004 Kromis et al. ..... 180/309
6,863,154 B2 * 3/2005 Uegane et al. ..... 181/207
7,240,769 B2 * 7/2007 Nezan et al. ..... 181/250

FOREIGN PATENT DOCUMENTS

JP S58-134618 U 9/1983
JP S61-74620 U 5/1986
JP 10-196358 A 7/1998
JP 2000-104543 A 4/2000
JP 2002-371841 A 12/2002

* cited by examiner

*Primary Examiner*—Hau V Phan
(74) *Attorney, Agent, or Firm*—Global IP Counselors, LLP

(57) ABSTRACT

An engine exhaust system for a vehicle is provided in which it is possible to obtain necessary vibration damping performance even when there are layout restrictions. For instance, a spherical joint on a front side of the vehicle and a spherical joint on a rear side of the vehicle, are positioned before and after two catalysts, and the components positioned between the front and rear spherical joints is unsupported by a vehicle body. Hence, a dynamic damper is formed. The resonant frequency of the dynamic damper, i.e. a frequency at which vibrations are absorbed can be adjusted by altering the modulus of elasticity and weight of the dynamic damper. Therefore, the necessary vibration damping performance can be obtained despite layout restrictions.

13 Claims, 6 Drawing Sheets

ENGINE EXHAUST SYSTEM FOR A VEHICLE

CROSS-REFERENCE TO RELATED APPLICATIONS

This nonprovisional application claims priority under 35 U.S.C. §119(a) to Japanese Patent Application No. 2004-191152 filed in Japan on Jun. 29, 2004, the entire contents of which are hereby incorporated by reference.

BACKGROUND OF THE INVENTION

1. Field of the Invention

The present invention generally relates to an engine exhaust system for a vehicle.

2. Background Information

Conventionally, a flexible coupling such as a spherical joint used in an exhaust system of a vehicle performs a vibration damping function by preventing transmission of vibrations from the engine to the exhaust system or preventing vibrations caused by resonance in the exhaust system being transmitted to the engine. Accordingly, the spherical joint plays an important role in reducing vibrations transmitted to a vehicle body via the mounts of the exhaust system and the engine system.

An engine exhaust system for a vehicle using a spherical joint has been applied to a front exhaust engine as shown in FIG. 7 of the drawings hereof, an example being disclosed in Japanese Unexamined Patent Publication No. 2002-371841, and to a rear exhaust engine as shown in FIGS. 8 and 9 of the drawings hereof, an example being disclosed in Japanese Unexamined Patent Publication No. 10-196358.

In the present specification, the terms 'front' and 'rear' and 'forward' and 'rearward' relate to the forward direction of travel of a vehicle. For example 'front exhaust' and 'rear exhaust' refer to the position of the exhaust manifold with respect to a transversely-mounted engine. The invention is not, however, limited to use in transverse-engine vehicles.

In the abovementioned conventional engine exhaust systems, it is necessary to arrange spherical joints in a particular way depending on their number, mounting location, and mounting angle. If vibrations of the exhaust system are to be absorbed effectively, the spherical joints must allow movement in the direction of the vibration. However, layout restrictions make it difficult to arrange the spherical joints in such a way that they can effectively absorb the vibrations. Where the spherical joints cannot be mounted in ideal locations and orientations due to a layout restriction, it is difficult to obtain satisfactory vibration damping performance.

SUMMARY OF THE INVENTION

The present invention has been developed to solve the above-mentioned problems, and has an object to provide an engine exhaust system for a vehicle in which it is possible to obtain effective vibration damping performance even if there is a layout restriction.

To achieve the abovementioned object, the present invention resides in an engine exhaust system for a vehicle, the system comprising at least two flexible couplings having elastic characteristics, positioned at two different locations in the exhaust system, and an intermediate component positioned between the at least two flexible couplings and having mass. The invention is characterised in that a dynamic damper is formed by virtue of the elastic characteristics and the mass.

Thus, an engine exhaust system for a vehicle according to the present invention comprises a dynamic damper formed by flexible couplings having a modulus of elasticity positioned in at least two locations in an exhaust system with an intermediate exhaust system component between them, where the mass of the intermediate component is effectively supported only by the flexible couplings.

According to the engine exhaust system of the present invention in which flexible couplings such as spherical joints are positioned in at least two places in an exhaust system and a dynamic damper is formed by an exhaust system component between the two flexible couplings as a mass body, it is possible to achieve necessary vibration damping performance even if there is a layout restriction in mounting the flexible couplings.

BRIEF DESCRIPTION OF THE DRAWINGS

Preferred embodiments of an engine exhaust system for a vehicle according to the present invention will now be described, by way of example, with reference to the accompanying drawings in which.

DETAILED DESCRIPTION OF THE PREFERRED EMBODIMENTS

Figure 7:
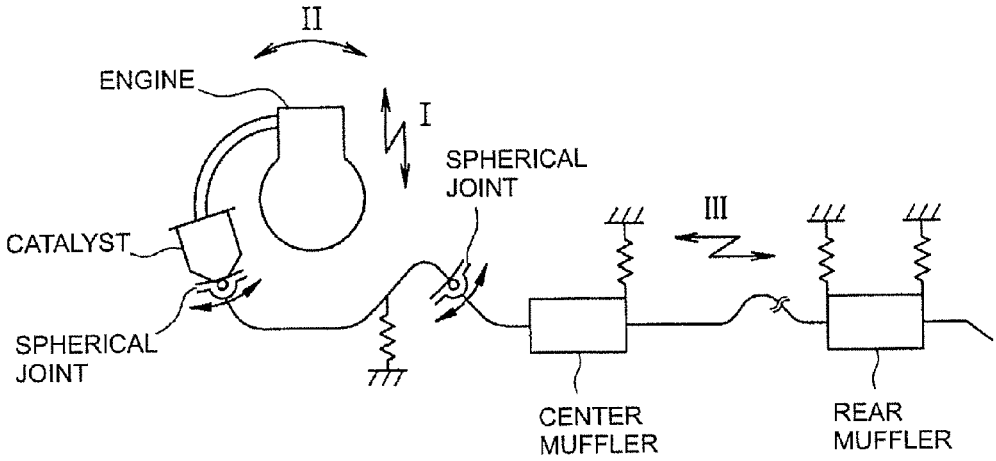
Fig.7 (Prior Art)
FIG. 7 (prior art) is a schematic diagram showing an example of a conventional engine exhaust system.

The conventional engine exhaust system shown in FIG. 7 has two spherical joints, one forward, one rearward, positioned between a catalyst and a center muffler. The engine is a front exhaust engine in this instance. An exhaust pipe located between the spherical joints is supported by the vehicle body. As a result, the forward spherical joint nearest the engine absorbs vibrations of the exhaust system longitudinally with respect to the vehicle and the rearward spherical joint nearest the center muffler absorbs roll oscillations and vibrations of the engine in a vertical direction with respect to the vehicle. These various vibrations and oscillations are shown by the arrows in FIG. 7.

Figure 8:
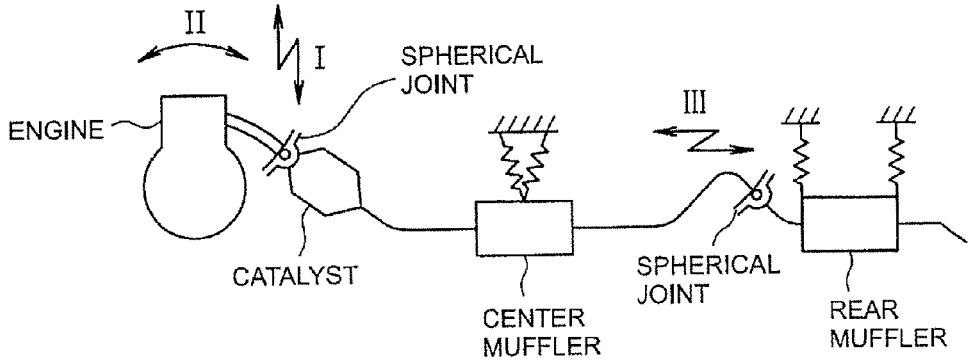
Fig.8 (Prior Art)
FIG. 8 (prior art) is a schematic diagram showing another example of a conventional engine exhaust system.

In another conventional engine exhaust system for a rear exhaust engine as shown in FIG. 8, a forward spherical joint is positioned between the engine and the catalyst, a rearward spherical joint is positioned between the center muffler and the rear muffler, and the vehicle body supports the center muffler. As a result, the forward spherical joint absorbs roll oscillations and vibrations of the engine in the vertical direction with respect to the vehicle and the rearward spherical joint absorbs vibrations of the exhaust system in the longitudinal direction with respect to the vehicle. Again, the various vibrations and oscillations are shown by the arrows in FIG. 8.

Figure 1:
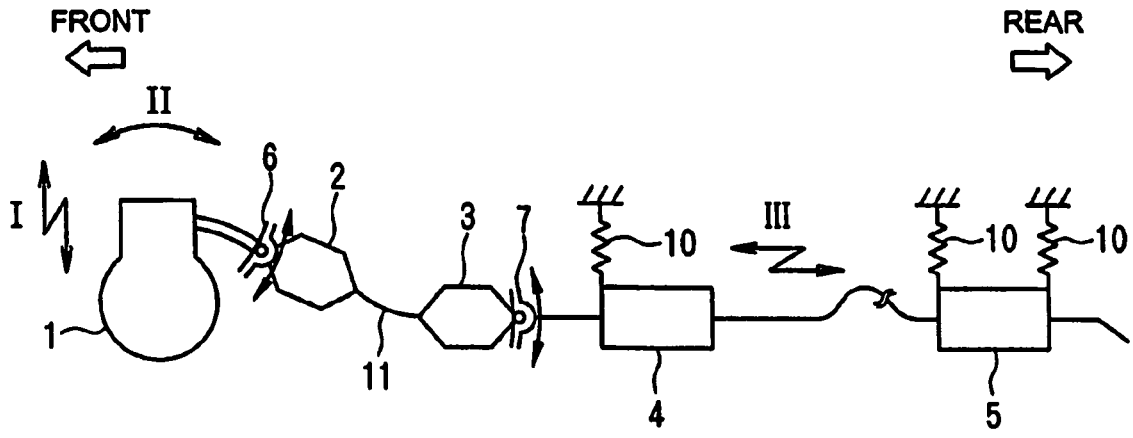
FIG. 1 is a schematic diagram showing a first preferred embodiment of an engine exhaust system.

Turning now to the present invention, FIG. 1 shows an engine exhaust system for a vehicle in a first preferred embodiment of the invention. As shown, the exhaust system comprises a rear exhaust engine 1, front and rear catalysts 2 and 3 joined by a front pipe 11, a center muffler 4, a rear muffler 5, and mount members 10 for mounting the mufflers 4 and 5 to a vehicle body. The front and rear catalysts 2, 3 are rigidly fixed to either end of the front pipe 11 and are movable as a single or unitary body, which arrangement provides good efficiency as a dynamic damper. Due to the weight of the center muffler 4 and the rear muffler 5, these parts of the exhaust system are supported from the vehicle body via the mount members 10.

In the present preferred embodiment, forward and rearward spherical joints 6 and 7, which are flexible couplings, are positioned respectively ahead of front catalyst 2, that is, forwardly with respect to the normal direction of travel of the vehicle and behind rear catalyst 3, that is, rearwardly with respect to the direction of travel. Each of the spherical joints 6, 7 includes an elastic body to absorb vibrations.

Exhaust system components located downstream from the rearward spherical joint 7 with respect to the generally rearward flow direction of exhaust gases are supported by the vehicle body via the mount members 10. Conversely, exhaust system components located between the two spherical joints 6 and 7 are not supported by the vehicle body. Consequently, the spherical joints 6 and 7 and the exhaust system components between the spherical joints 6 and 7, in this case the front and rear catalysts 2 and 3 and the pipe 11, form a dynamic damper.

In the first preferred embodiment, as shown by the arrows in FIG. 1, the forward spherical joint 6 absorbs roll oscillations of the engine 1 and longitudinal vibrations of the exhaust system with respect to the vehicle, and the rearward spherical joint absorbs vertical vibrations of the engine 1 with respect to the vehicle.

Figure 2:
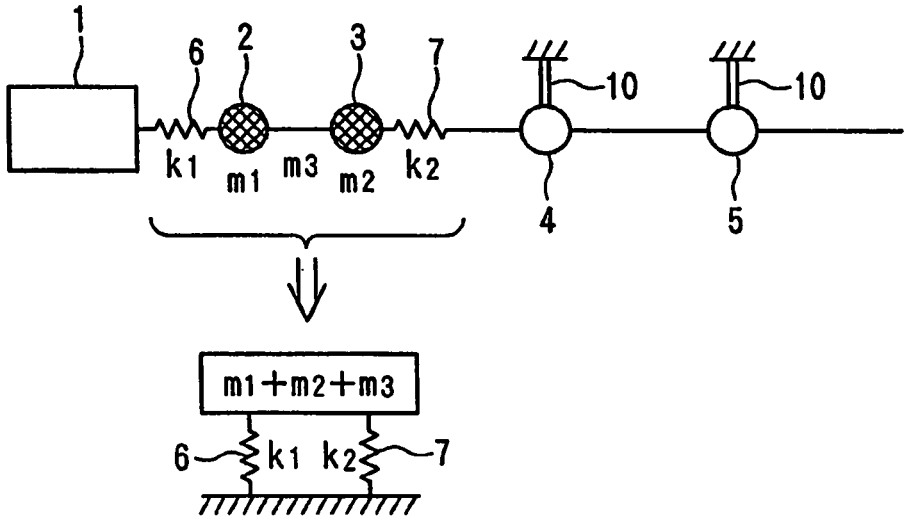
FIG. 2 shows a model of the engine exhaust system for the vehicle in FIG. 1.

FIG. 2 shows a vibration system model of the engine exhaust system in the first preferred embodiment, hence comprising the two spherical joints 6 and 7 and the exhaust system components therebetween. Assuming here that the mass of the front catalyst 2 is m1, the mass of the rear catalyst 3 is m2, the mass of the tube 11 between those two catalysts 2 and 3 is m3, the modulus of elasticity of the forward spherical joint 6 is k1, and the modulus of elasticity of the rearward spherical joint 7 is k2, the mass M of the dynamic damper formed between the forward spherical joint 6 and the rearward spherical joint 7, is expressed by:

$$M=(m1+m2+m3)$$

and its modulus of elasticity K is expressed by:

$$K=(k1+k2)$$

The resonant frequency f of the dynamic damper is expressed by the following equation:

$$f=\tfrac{1}{2}\pi(K/M)^{1/2}$$

Figure 3:
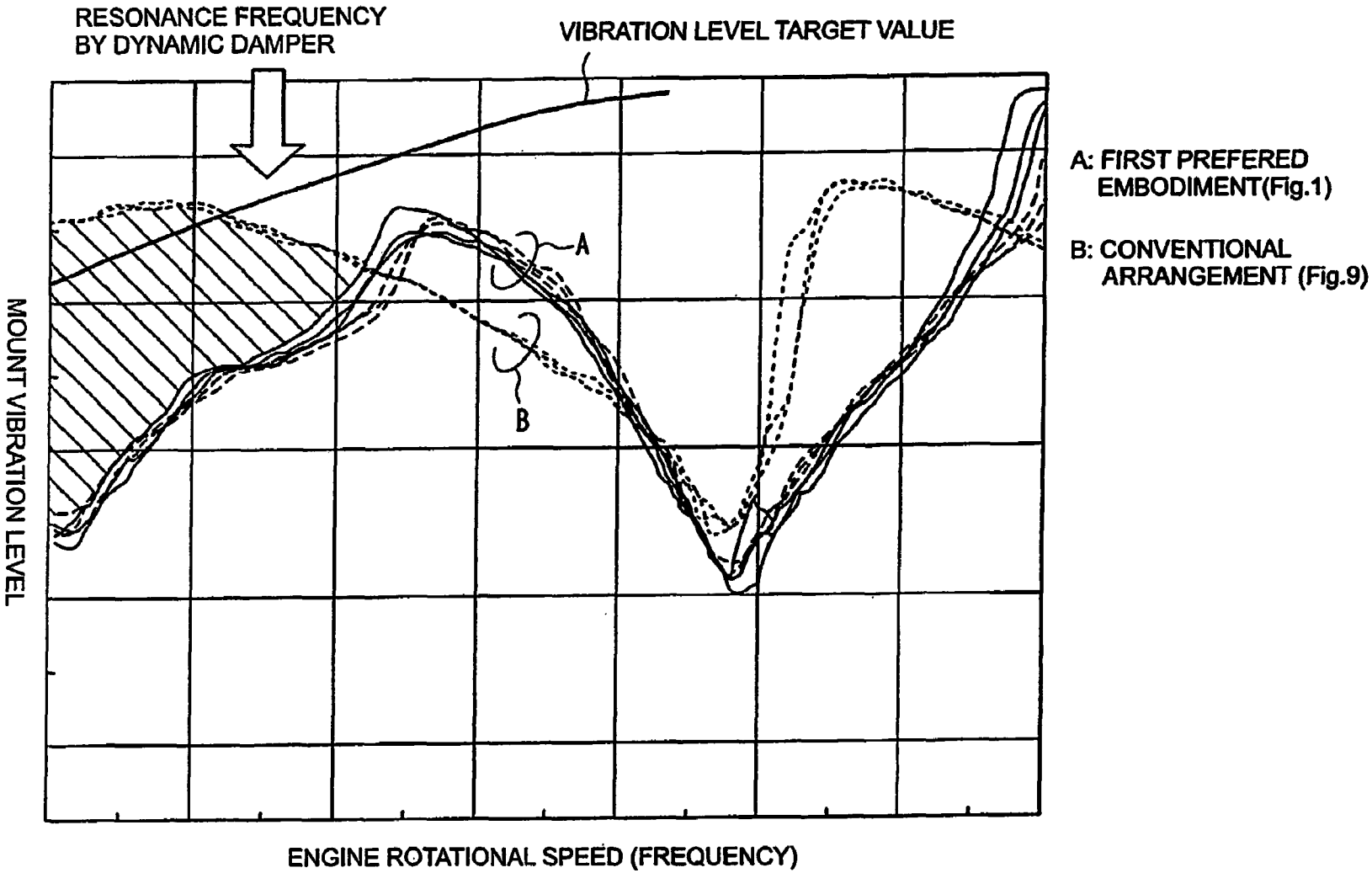
FIG. 3 is a graph showing mount vibration level against frequency for the engine exhaust system of FIG. 1.
Figure 9:
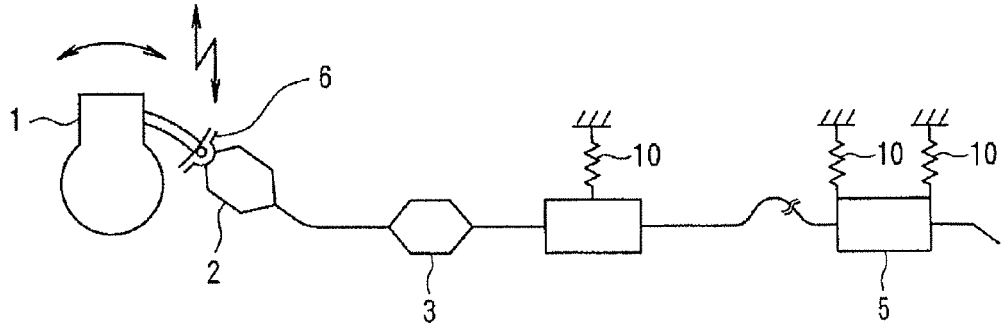
Fig.9 (Prior Art)
FIG. 9 (prior art) is a schematic diagram showing a further example of a conventional engine exhaust system.

FIG. 3 compares the mount vibration level of the engine exhaust system in accordance with the first preferred embodiment (A in the figure) and the mount vibration level of an engine exhaust system for a vehicle according to the conventional technology shown in FIG. 9 (B in the figure) corresponding to JP 10-196358. As seen from FIG. 3, the mount vibration level of the conventional engine exhaust system exceeds a target value at a low engine speed range, i.e. in a low-frequency region such as when the engine is idling, whereas the mount vibration level of the engine exhaust system embodiment of FIG. 1 is below the target value, achieving a favourable vibration reducing effect.

Figure 4:
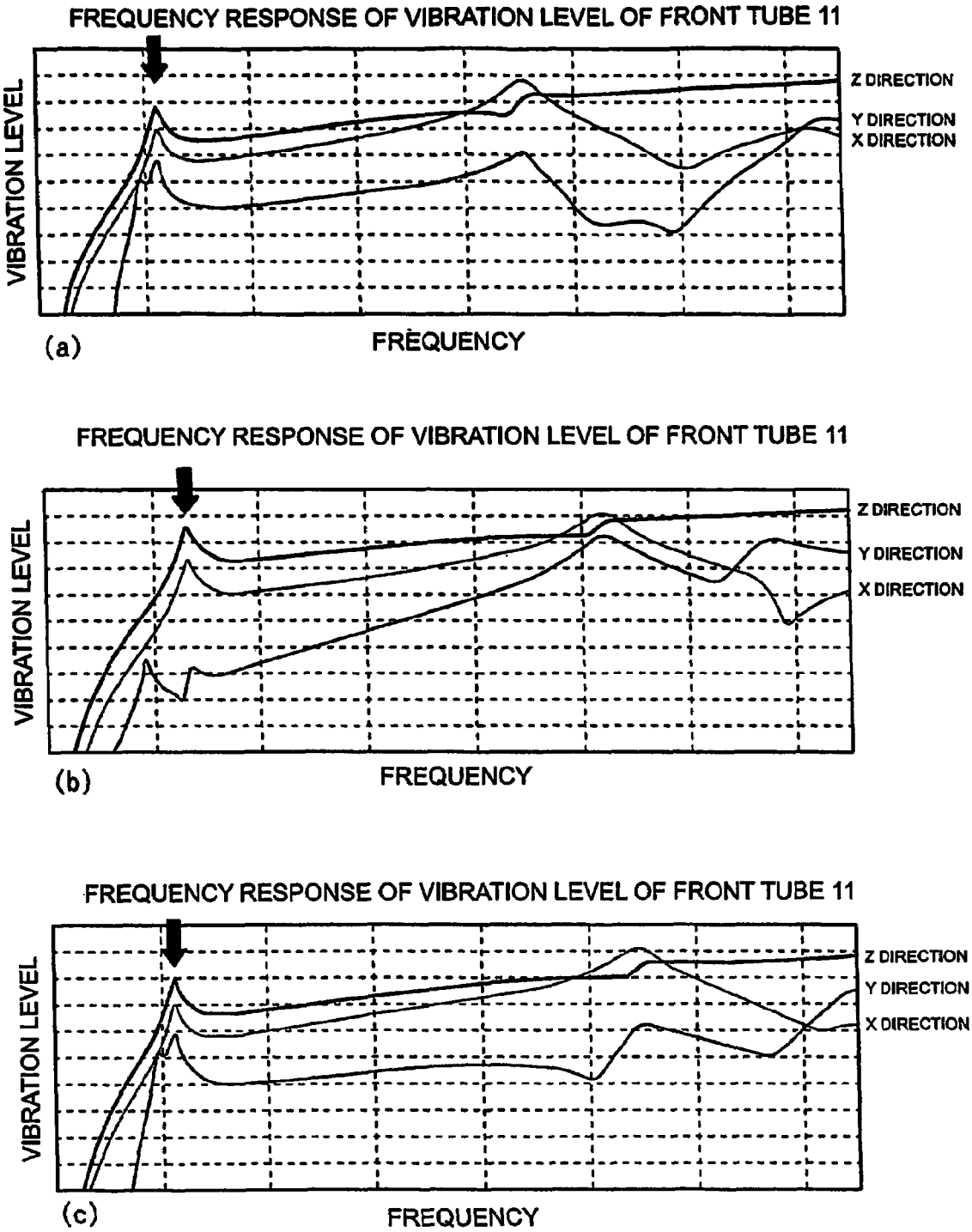
FIGS. 4*a* to 4*c* are vibration frequency response graphs showing adjustment of the resonant frequency of the engine exhaust system of FIG. 1.

The graphs in FIGS. 4*a* to 4*c* show how the resonant frequency of the dynamic damper can be adjusted so as efficiently to reduce vibrations at a particular frequency. Altering the modulus of elasticity K of the dynamic damper or increasing or decreasing the overall mass of the intermediate exhaust system components between the spherical joints 6 and 7 both have the effect of adjusting the resonant frequency.

In many cases, engine vibration is the main or only cause of vibration of the exhaust system. Since engine vibration frequency is usually found to be in the range of approximately 20-30 Hz, the elastic characteristics of the dynamic damper and/or the mass of the intermediate exhaust components may be selected to ensure that the resonant frequency of the dynamic damper is less than this range. Thus, in the preferred embodiment, k1, k2 and/or M are selected so that the resonant frequency of the dynamic damper formed by the flexible couplings 6, 7 and the intermediate components 2, 3 and 11 is less than approximately 20-30 Hz.

For example, when the modulus of elasticity K of the dynamic damper is increased, i.e. the rigidity of the spherical joints is enhanced relative to the system whose vibration characteristics are shown in FIG. 4*a*, the resonant frequency increases as shown by the arrow in FIG. 4*b*. On the contrary, when the modulus of elasticity K of the dynamic damper is decreased, i.e. the rigidity of the spherical joints is reduced, the resonant frequency decreases. Also, when the mass M of the dynamic damper is increased, i.e. the weight of the intermediate components is increased, the resonant frequency decreases as shown in FIG. 4*c*. On the contrary, the resonant frequency increases when the mass M of the dynamic damper is decreased, i.e. the weight of the exhaust system components is reduced. So, the engine exhaust system of the invention can easily achieve a vibration reducing effect with respect to a desired frequency, and has the advantage of being able to achieve a vibration reducing effect even if there is a restriction on the layout of the spherical joints.

Figure 5:
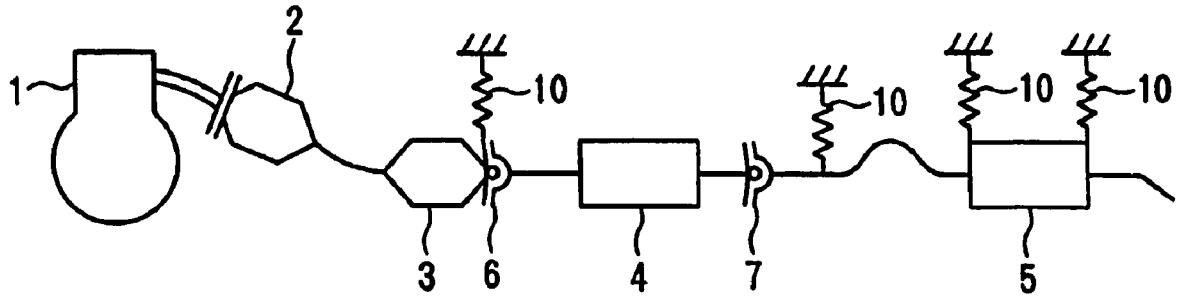
FIG. 5 is a schematic diagram showing a second preferred embodiment of an engine exhaust system.

An engine exhaust system according to the present invention is not limited to the above-mentioned first preferred embodiment but is applicable to any form of engine exhaust. For example, FIG. 5 shows a second preferred embodiment of the present invention in which an engine exhaust system is applied to a rear exhaust engine as in the first preferred embodiment but in this instance the forward spherical joint 6 is disposed behind the rear catalyst 3 and the rearward spherical joint 7 is disposed behind the center muffler 4. Sections of the exhaust system upstream and downstream of the respective spherical joints 6 and 7 are supported by and connected to the vehicle body via mount members 10, whereas the center muffler 4 is not mounted to the vehicle body. As no part of the center muffler is directly connected to the vehicle body; so, like the intermediate components of the first embodiment, the center muffler is only supported by the spherical joints 6 and 7. Hence, a dynamic damper is formed between the forward spherical joint 6 and the rearward spherical joint 7. In this case, the major mass body of the dynamic damper is the center muffler 4.

Figure 6:
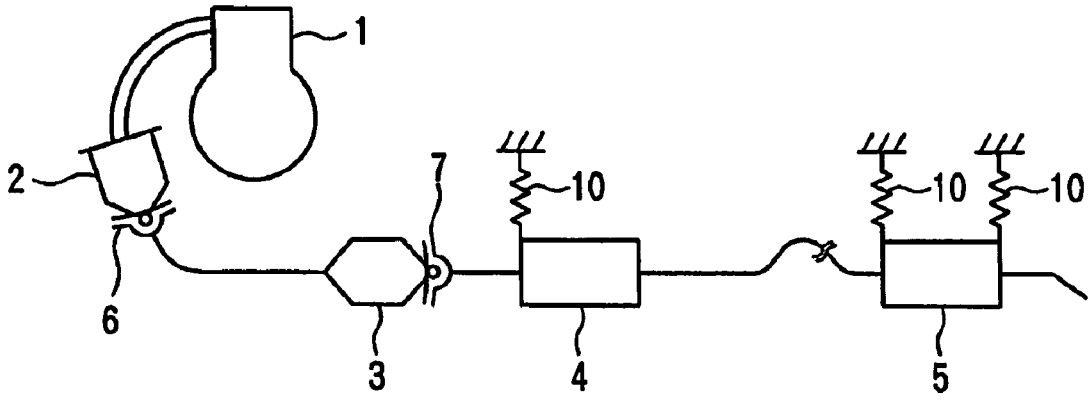
FIG. 6 is a schematic diagram showing a third preferred embodiment of an engine exhaust system.

In a further example, FIG. 6 shows a third preferred embodiment of the invention in which an engine exhaust system for a vehicle is applied to a front exhaust engine. Here, the forward spherical joint 6 is positioned between the front catalyst 2 and the rear catalyst 3 and the rearward spherical joint 7 is positioned between the rear catalyst 3 and the center muffler 4. No part of the rear catalyst 3 is supported by or directly connected to the vehicle body, so a dynamic damper is formed between the forward spherical joint 6 and the rearward spherical joint 7. In this case, the major mass body of the dynamic damper is the rear catalyst 3.

An engine exhaust system for a vehicle according to the present invention is provided with flexible couplings formed, for example, from spherical joints positioned in at least two locations in the exhaust system such that at least one exhaust system component, for example the front and rear catalysts, is suspended between the two spherical joints, unsupported by the vehicle body to form a dynamic damper. The vibration reducing effect of this dynamic damper can be adjusted by adjusting the resonant frequency of the exhaust system, which can be adjusted by altering the modulus of elasticity of the dynamic damper, i.e. the modulus of elasticity of the spherical joints, and/or the mass of the dynamic damper. Alteration of mass can be achieved by changing the mass of the components that form the dynamic damper or by altering the configuration or number of the components that are used to form the dynamic damper. For example, in the first preferred embodiment the dynamic damper is defined by the forward and rearward spherical joints, the front and rear catalysts and the front pipe. Conversely, in the second embodiment the dynamic damper is defined by the forward and rearward spherical joints, the center muffler and the associated pipes. These are examples of how the mass of the dynamic damper can be altered by changing the configuration or number of the components in various ways.

The invention claimed is:

1. An engine exhaust system for a vehicle, comprising:

at least two flexible couplings having elastic characteristics, positioned at two different locations in the exhaust system, the at least two flexible coupling including an upstream flexible coupling and a downstream flexible coupling;

an upstream component positioned further upstream of the upstream flexible coupling;

a downstream component positioned further downstream of the downstream flexible coupling and mounted to a body of the vehicle;

an intermediate component positioned between the upstream flexible coupling and the downstream flexible coupling and having mass, the intermediate component being coupled to the upstream component via the upstream flexible coupling and coupled to the downstream component via the downstream flexible coupling, the intermediate component being free of direct connections to the body of the vehicle between the upstream and downstream flexible couplings such that the intermediate component freely floats between the upstream and downstream flexible couplings with respect to the body of the vehicle, the intermediate component including a catalyst; and a dynamic damper formed between the upstream component and the downstream component by virtue of the elastic characteristics and the mass, with the elastic characteristics of the flexible couplings being selected to optimize the resonant frequency of the dynamic damper with respect to the mass of the intermediate component.

2. The exhaust system according to claim 1, wherein the mass of the intermediate component is selected to optimize the resonant frequency of the dynamic damper.

3. The exhaust system according to claim 1, wherein the upstream flexible coupling is configured and arranged to be closer to an engine than to a muffler, the downstream flexible coupling is configured and arranged to be closer to the muffler than to the engine, and the downstream component is configured and arranged to be positioned between the downstream flexible coupling and the muffler, the downstream component being configured and arranged to be mounted to the body of the vehicle.

4. The exhaust system according to claim 1, wherein the upstream flexible coupling has a first elastic characteristic and the downstream flexible coupling has a second elastic characteristic, the first and second elastic characteristics being selected such that a resonant frequency of the section formed by the flexible couplings and the intermediate component is lower than 30 Hz.

5. The exhaust system according to claim 1, wherein the intermediate component has a mass which is selected such that a resonant frequency of the section formed by the flexible couplings and the intermediate component is lower than 30 Hz.

6. An engine exhaust system for a vehicle, comprising:

at least two flexible couplings having elastic characteristics, positioned at two different locations in the exhaust system, the at least two flexible coupling including an upstream flexible coupling and a downstream flexible coupling;

an upstream component positioned further upstream of the upstream flexible coupling;

a downstream component positioned further downstream of the downstream flexible coupling and mounted to a body of the vehicle; and an intermediate component positioned between the upstream flexible coupling and the downstream flexible coupling and having mass so that a dynamic damper is formed between the upstream component and the downstream component by virtue of the elastic characteristics and the mass, with the elastic characteristics of the flexible couplings being selected to optimize the resonant frequency of the dynamic damper with respect to the mass of the intermediate component, the intermediate component being coupled to the upstream component via the upstream flexible coupling and coupled to the downstream component via the downstream flexible coupling, the intermediate component being free of direct connections to the body of the vehicle between the upstream and downstream flexible couplings such that the intermediate component freely floats between the upstream and downstream flexible couplings with respect to the body of the vehicle, the intermediate component including a catalyst.

7. The engine exhaust system according to claim 6, wherein the mass of the intermediate component is selected to optimize the resonant frequency of the dynamic damper.

8. The engine exhaust system according to claim 6, wherein each of the upstream flexible coupling and the downstream flexible coupling includes a spherical joint.

9. The engine exhaust system according to claim 6, wherein the mass of the intermediate component and the elastic characteristics of the flexible couplings are selected to optimize the resonant frequency of the dynamic damper.

10. An engine exhaust system for a vehicle having a body, the engine exhaust system comprising:

an upstream flexible coupling having a first elastic characteristic;

a downstream flexible coupling having a second elastic characteristic;

an intermediate component positioned between the upstream flexible coupling and the downstream flexible coupling and having a mass, the intermediate component being free of direct connections to a body of the vehicle between the upstream and downstream flexible couplings such that the intermediate component freely floats between the upstream and downstream flexible couplings with respect to the body of the vehicle, the intermediate component including a catalyst;

an upstream component positioned further upstream of the upstream flexible coupling, the upstream component being coupled to the intermediate component via the upstream flexible coupling; and a downstream component positioned further downstream of the downstream flexible coupling, the downstream component being coupled to the intermediate component via the downstream flexible coupling, the downstream component being mounted to the body of the vehicle, with the elastic characteristics of the flexible couplings being selected to optimize the resonant frequency of the vibration system with respect to the mass of the intermediate component, with the vibration system being formed of the couplings and the intermediate component between the upstream component and the downstream component.

11. The engine exhaust system according to claim 10, wherein the mass of the intermediate component is selected to optimize the resonant frequency of the vibration system formed of the couplings and the intermediate component.

12. The engine exhaust system according to claim 10, wherein each of the upstream flexible coupling and the downstream flexible coupling includes a spherical joint.

13. The engine exhaust system according to claim 10, wherein the mass of the intermediate component and the elastic characteristics of the flexible couplings are selected to optimize the resonant frequency of the dynamic damper.

* * * * *